US005209031A

United States Patent [19]

Tavano

[11] Patent Number: 5,209,031

[45] Date of Patent: May 11, 1993

[54] SLOPED GLAZING STRUCTURE

[76] Inventor: John Tavano, 28 Edgewood Dr., Torrington, Conn. 06790

[21] Appl. No.: 867,032

[22] Filed: Apr. 10, 1992

[51] Int. Cl.[5] ..... E04B 7/06

[52] U.S. Cl. ..... 52/92.2; 52/235; 52/645

[58] Field of Search ..... 52/73, 90, 91, 92, 94–96, 52/200, 235, 298, 775, 645, 713

[56] References Cited

U.S. PATENT DOCUMENTS

| | | | |
|---|---|---|---|
| 1,464,783 | 8/1923 | Sylvan | 52/94 |
| 1,931,750 | 10/1933 | Blaski | 52/94 |
| 3,452,498 | 7/1969 | Kinsey | 52/94 |
| 4,114,330 | 9/1978 | Sukolics | 52/200 |
| 4,195,452 | 4/1980 | Smith et al. | 52/94 |
| 4,261,143 | 4/1981 | Rizzo | 52/92 |
| 4,296,576 | 10/1981 | Rice, Jr. et al. | 52/713 |
| 4,463,534 | 8/1984 | Crigler | 52/200 |
| 4,478,013 | 10/1984 | Tavano | 52/92 |
| 4,638,613 | 1/1987 | Tonsmann | 52/235 |
| 4,658,559 | 4/1987 | Doherty | 52/90 |
| 4,872,297 | 10/1989 | Hetzel et al. | 52/92 |
| 4,956,950 | 9/1990 | Hirose | 52/94 |
| 4,998,389 | 3/1991 | Pritts | 52/645 |

*Primary Examiner*—Carl D. Friedman
*Assistant Examiner*—Winnie Yip
*Attorney, Agent, or Firm*—McCormick, Paulding & Huber

[57] ABSTRACT

Extruded aluminum members are provided in a framework for supporting glazed panels in an inclined or sloped glazing structure. A sill at the lower edge of the glazed panels has an upper surface that defines a raised portion of the convex contour to receive a concavely contoured support bar at an angle alpha which may very depending upon the particular installation. The upper edge of the glazed roof structure is supported by a header which is designed with a ribbed flange that can be combined with a mating top bar of L-shape cross section in a variety of positions to accommodate different angles alpha between a vertical wall against which the inclined structure is mounted and the plane of the sloped glazing structure itself.

3 Claims, 2 Drawing Sheets

SLOPED GLAZING STRUCTURE

BACKGROUND OF THE INVENTION

This invention relates generally to a sloped roof structure of extruded aluminum for supporting glazing panels of the type generally used in either vertical curtain wall systems or in such glazing structures generally.

The present invention represents an improvement over that disclosed in my prior Pat. No. 4,478,013. In my prior patent the sloped glazing structure framework provided for a flat sill member and upwardly sloping rafters which rested on the sill and included channel defining portions to support the panels. Each rafter also included a stem portion and an integral cap provided above the surface of the panels themselves. One object of the above mentioned patent was to provide internal means for disposing of water and condensation inside the sloped glazing structure itself.

SUMMARY OF THE INVENTION

The present invention provides for an improved extruded aluminum framework structure for a sloped glazing roof structure.

In accordance with the present invention the improved sloped glazing structure disclosed provides support for the glazed panels in an inclined condition and supports these panels from an existing wall structure and from the upper edge of a conventional wall structure including a conventional glazed wall structure.

An elongated horizontally extending sill has a cross sectional shape that includes a raised portion running in the longitudinal direction. The upper surface of the raised portion is convex having a radius such that a longitudinal extending support bar is supported on this raised portion at any angle within a range of angles to provide for different angles for the rafters of the sloped glazing structure.

An elongated header is provided along the upper edge of the glazed panels and this header has a cross sectional shape such that it includes an upper flange, opposite a channel portion adapted to receive the glazing structure rafters. This upper flange defines a top surface of convex contour and this convexly contoured upper flange is adapted to receive an L-shaped top bar having one flange for securing the structure to a wall, and having a second flange of concave contour to mate with the convexly contoured upper flange of the header.

The rafters are T-shaped as in my prior patent but instead of providing for an integral cap I have instead eliminated the integral cap, and the need for L-shaped stops to secure the glazed panels to the rafters. The T-shaped rafters herein are also of such a cross sectional shape such that the laterally projecting portions of the T define channels on either side of a vertically extending stem portion, but the stem portion includes spaced bifurcations which are adapted to receive screws that secure a V-shaped cap to the T-shaped rafters. The V-shaped cap has lower flanges for engaging the glazed panels.

DETAILED DESCRIPTION

Figure 2:
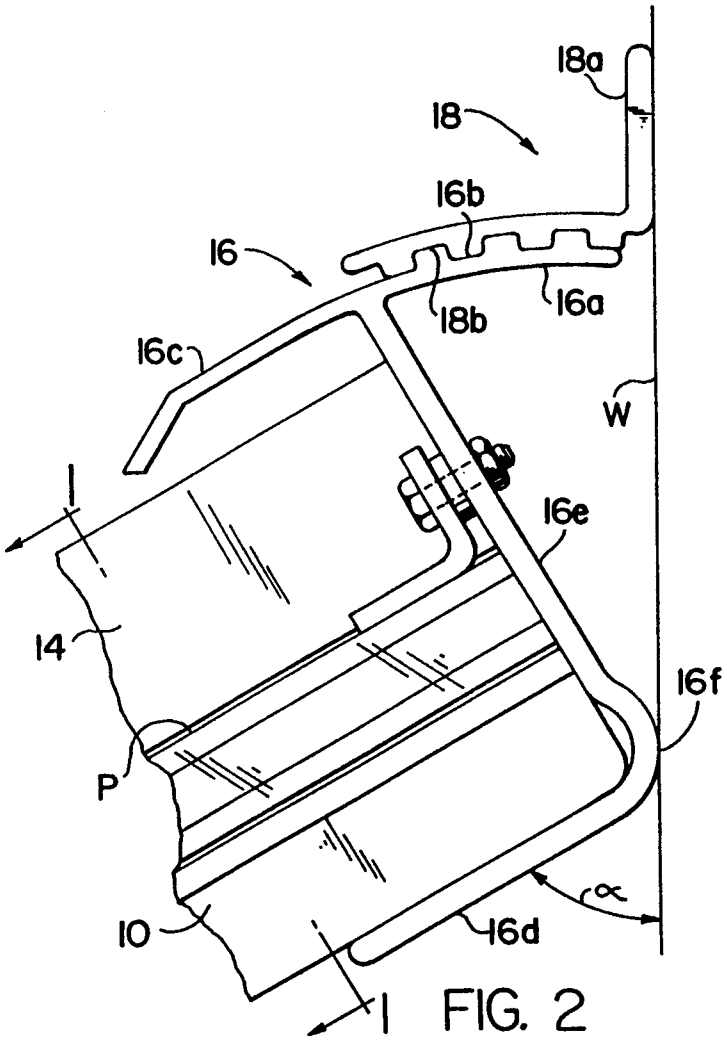
FIG. 2 is a vertical section taken through the upper edge portion of the sloped glazing structure and illustrates in detail the cross sectional configuration of the header and its associated top bar.
Figure 1:
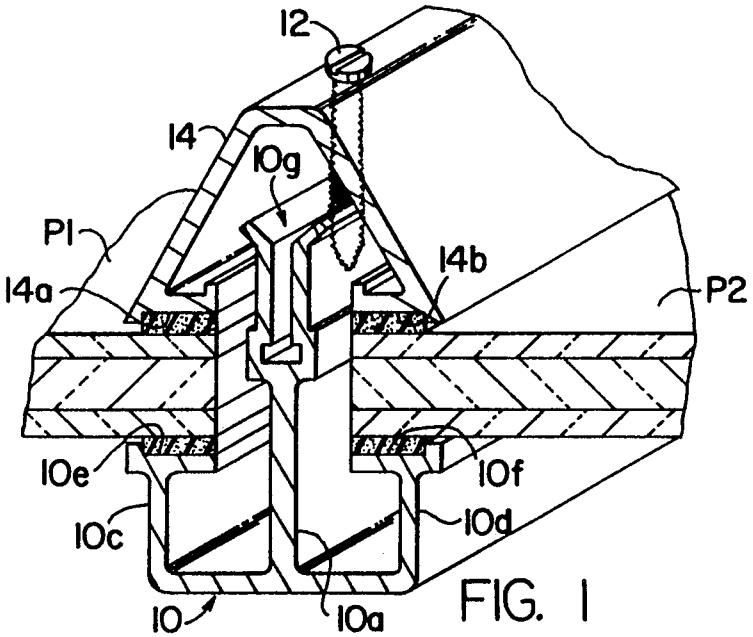
FIG. 1 is a sectional view taken generally through one of the T-shaped rafters and illustrates the V-shaped cap secured to the stem portion of the T-shaped rail so as to secure two adjacent glazed panels in the extruded aluminum framework of the sloped glazing structure.

FIG. 1 is a generally vertical section taken along the lines 1—1 of FIG. 2 and illustrates the cross sectional configuration for one of several rafters provided in a glazed roof structure of the type adapted to be provided in inclined relationship to a generally vertical wall W as illustrated in FIG. 2.

One feature of the present invention is provide an inclined glazed roof structure that can be adapted for mounting against a vertical wall W at a range of angles, one such angle being indicated at alpha in FIG. 2.

Each rafter comprises an extruded element 10 which is of generally inverted T-shape when viewed in cross section (FIG. 1) with lower portions provided on either side of a stem portion 10*a*. These lower portions define channels on either side of the stem portion 10*a* and each channel defining portion 10*c* and 10*d* further includes a panel edge support surface 10*e* and 10*f* respectively. As so constructed and arranged the generally T-shaped rafter is similar to that shown and described in my prior patent. However, instead of an integral cap portion provided at the upper edge of the stem portion 10*a* I have instead substituted a bifurcated upper portion 10*g* of the stem portion 10*a* in order to provide a convenient means for receiving threaded screw means 12, and to thereby connect and elongated V-shaped cross sectional cap member 14 which is not integral with the T-shaped rafter but which is secured thereto in such a manner that the glass panels P1 and P2 are clamped between panel engaging portions 14*a* and 14*b* of the cpa 14 as a result of the above described screw means.

As best shown in FIG. 2 the panel or panels P are held in position along their upper marginal edges by an elongated horizontally extending header 16. The header defines an elongated channel for receiving the upper edges of the glass panel or panels which are oriented at an angle alpha as mentioned previously.

The header has a cross sectional shape that includes an upper flange 16*a* provided generally opposite the channel portion thereof. This flange 16*a* has an upper or top surface convex contour and preferably one that defines a series of elongated ribs with grooves therebetween as shown at 16*b*. The convexly contoured upper surface of the flange 16*a* is adapted to mate with underside of a generally L-shaped header top bar 18, and it is a feature of the present invention that these mating surfaces 16*b* and 18*b* can provide for a range of angles alpha between the angle of each of the rafters 10 and the vertical wall W.

The L-shaped top bar 18 has a vertically extending flange 18*a* which mates with and is secured of the all W by conventional means (not shown). The lower flange and more particularly the bottom surface thereof 18*b* is concavely contoured so as to mate with the convex contour of the flange 16*a* of the header 16.

The channel shaped portion of the header 16 is defined by upper and lower legs 16*c* and 16*d* as well as by a web portion 16*e* that integrally connects both these spaced leg portions 16*c* and 16*d* to one another. At one of these integrally connected portions, that is the vertex 16*f* connecting the web 16*e* with the lower leg 16*d* is of rounded contour so as to provide a convenient fulcrum point and point of abutment between the header 16 and the wall W. With the configuration illustrated of this corner 16*f* of the header 16 a range of angles alpha can be accommodated so to provide a great degree of flexibility of the installer of the glazed roof structure to meet the particular architectural requirements of a variety of customers.

Figure 3:
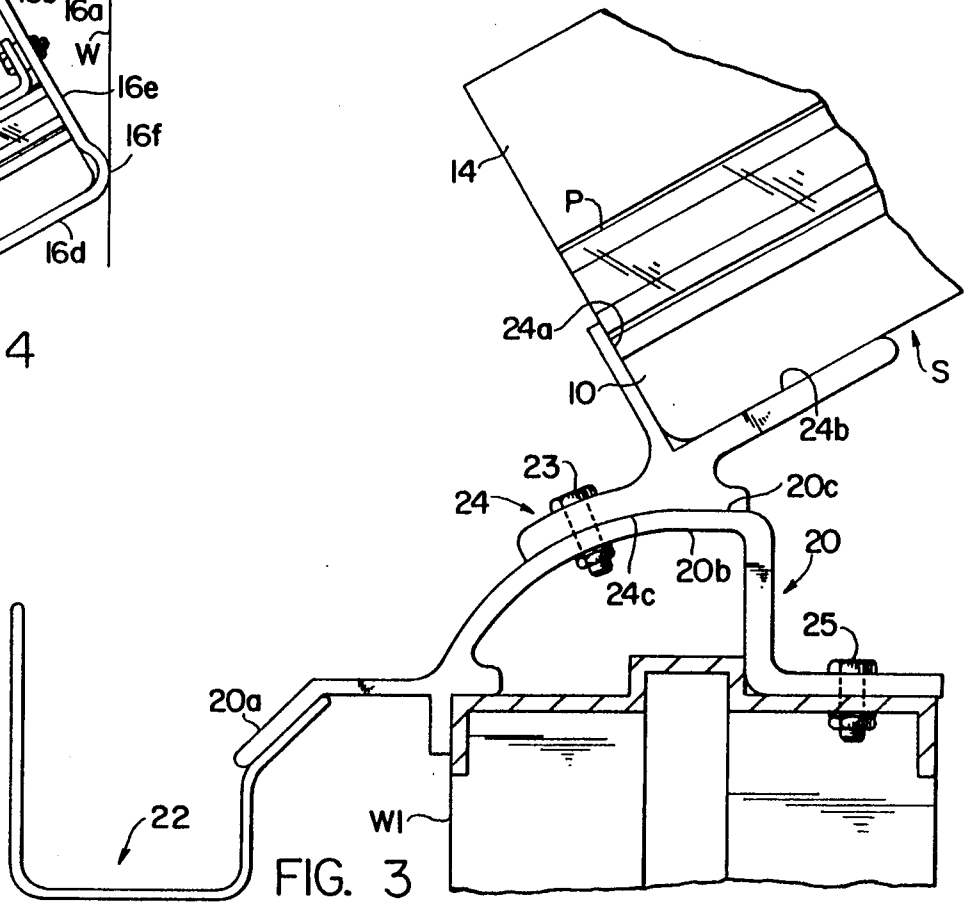
FIG. 3 is a vertical section taken generally through the lower edge portion of the sloped glazing structure illustrating the sill and longitudinally extending support bar for supporting the lower edge of the glazed panels.
Figure 4:
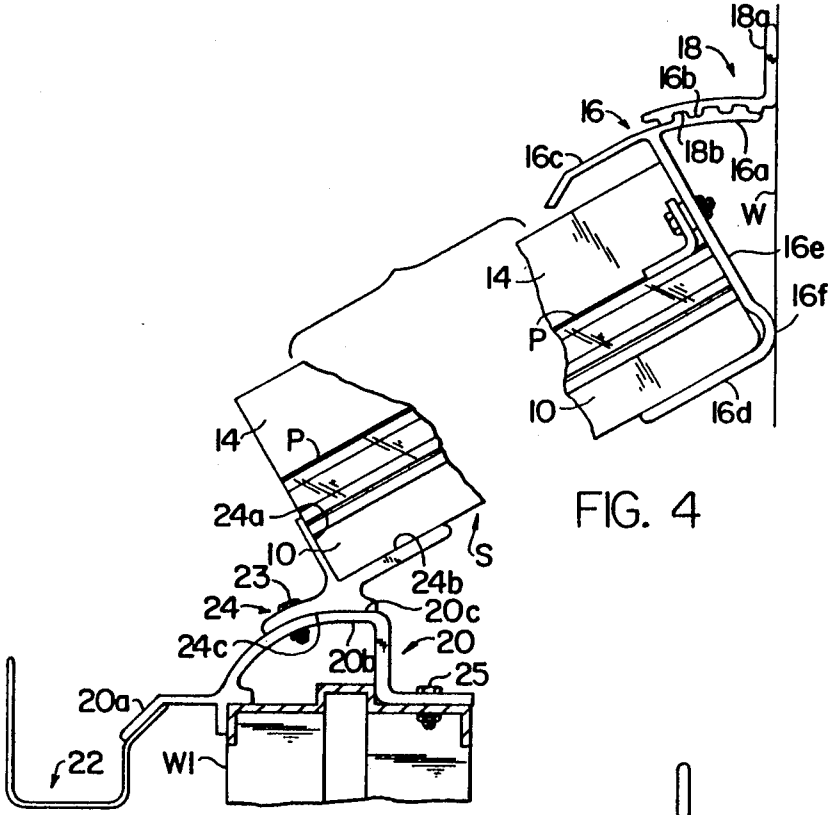
FIG. 4 is a view combining FIGS. 2 and 3, and illustrates the overall configuration or the invention disclosed.

Turning next to the configuration for supporting the lower edge portion of the sloped glazing structure FIG. 3 shows a conventional vertical glass wall W1 with the sloped glazing structure S supported throughout the wall W1 by an elongated horizontally extending sill 20 secured to the upperedge of the wall W1 by conventional means, and which sill 20 includes a projecting flange 20*a* that in turn supports an elongated gutter 22 for carrying off the moisture from both the upper surface and the under surface of the sloped wall structure S.

Still with reference of the horizontally extending cylinder member 20, FIG. 3 shows the sill 20 as including a cross sectional shape that defines a raised portion 20*b* which has a top or upper surface of convex contour 20*c* for receiving the concave surface of an elongated support bar adapted to support the lower edge of panel P.

The elongated panel lower edge support bar 24 has mutually perpendicular elongated panel supports surfaces 24*a* and 24*b* arranged on the upper surface thereof and generally opposite the concavely contoured lower surface 24*c* of the panel lower edge support bar 24. Conventional fastener means 23 is provided for securing the elongated panel lower edge support bar 24 to the raised convexly contoured portion 20*c* of the horizontally extending sill 20 in the desired angular relationship of the inclined sloped glazing structure S.

The disclosure in my prior Pat. No. 4,478,013 is incorporated by reference herein. The description herein is limited to the improvements provided in the sloped glazing structure in accordance with the present invention, ti will be apparent that other features f my prior patent can be combined with the features described and claimed in he present application. More specifically, purlin means may be provided between the rafters and may support the adjacent edges of glazing panels where more tan one glazing panel is required for a structure S having a dimension between the lower and upper edges thereof greater than the permitted by a single panel P.

Still will reference to my prior art Pat. No. 4,478,013 it will be apparent from FIG. 1 that the T-shaped rail shown is intended for use at a location between adjacent panels P1 and P2 of the sloped glazing structure. A similar eraser is used a the opposite edges of he sloped glazing structure and in such case one side of the T need not be provided. However, the bifurcated upper portion of the seam 10*a* will be provided and differently configured cap 14 can be used in associated with such an end rafter (not shown).

I claim:

1. A sloped glazing structure adapted to support glazed panels in an inclined condition from an existing wall structure and comprising:

a) an elongated horizontally extending sill adapted for mounting on a wall structure and having a cross sectional shape that defines a raised portion int the upper surface thereof that is of convex contour, b) an elongated panel lower edge support bar having mutually perpendicular elongated panel support surfaces for supporting the panel lower edge, and having a concave lower surface that mates with said convex contour of said sill for supporting the lower edge of a glazed panel at an angle alpha in a range of slope angles, c) an elongated header having an elongated channel for receiving the upper edges of glass panels oriented at said angle alpha, said header having a cross sectional shape that includes an upper flange opposite said channel, said upper flange defining a top surface of convex contour, said convex contour of said header upper flange defining longitudinally extending ribs and d) an elongated top bar of L-shape cross section with one flange for engaging the wall and with a second flange of concave contour to mate with said convex contour of said header upper flange and mating ribs defined by said concave contour of said second flange.

2. The sloped glazing structure of claim 1 further characterized by T-shaped rafters provided perpendicularly between said header and said sill, each said T-shaped rafter having an inverted T-shape cross sectional shape such that laterally projecting lower portions define channels on either side of a vertically upwardly extending stem portion of said t-shape, each rafter channel defining portion having a panel edge support surface, each rafter stem portion further including spaced bifurcation defined in said stem portion, and an elongated cap having laterally projecting portions for engaging said panel lateral edges and covering said rafter stem portion.

3. The sloped glazing structure of claim 2 wherein said cap is of inverted V-shape cross section, and screw means at the vertex for securing said V-shape cap to said rafter stem portion by threadably receiving said screw means between said bifurcations.

* * * * *